US010011938B2

(12) United States Patent
Kim et al.

(10) Patent No.: US 10,011,938 B2
(45) Date of Patent: Jul. 3, 2018

(54) LAUNDRY TREATMENT APPARATUS

(71) Applicant: LG ELECTRONICS INC., Seoul (KR)

(72) Inventors: Kyeonghwan Kim, Seoul (KR); Jaehyun Kim, Seoul (KR); Jaewon Chang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 623 days.

(21) Appl. No.: 14/303,789

(22) Filed: Jun. 13, 2014

(65) Prior Publication Data

US 2014/0366591 A1 Dec. 18, 2014

(30) Foreign Application Priority Data

Jun. 13, 2013 (KR) ..... 10-2013-0067878

(51) Int. Cl.
*D06F 37/22* (2006.01)
*D06F 37/24* (2006.01)

(52) U.S. Cl.
CPC ..... *D06F 37/225* (2013.01); *D06F 37/245* (2013.01)

(58) Field of Classification Search
None
See application file for complete search history.

(56) References Cited

U.S. PATENT DOCUMENTS

2012/0278996 A1* 11/2012 Park ..... D06F 33/02 8/137
2013/0025330 A1* 1/2013 Bae ..... D06F 37/304 68/140

FOREIGN PATENT DOCUMENTS

| | | | |
|---|---|---|---|
| CN | 2061339 | U | 8/1990 |
| CN | 2198690 | Y | 5/1995 |
| CN | 2854871 | Y | 1/2007 |
| CN | 102782201 | A | 11/2012 |
| CN | 102899847 | A | 1/2013 |
| EP | 2514864 | A2 | 10/2012 |
| EP | 2551398 | A1 | 1/2013 |
| EP | 2671995 | A1 | 12/2013 |
| KR | 10-2013-0017355 | A | 2/2013 |

* cited by examiner

*Primary Examiner* — Jason Ko
(74) *Attorney, Agent, or Firm* — Dentons US LLP

(57) ABSTRACT

Disclosed is a laundry treatment apparatus. The laundry treatment apparatus includes a drum rotatably placed in a cabinet defining an external appearance of the laundry treatment apparatus, a housing secured to the drum, a receiving space defined in the housing, a balancing unit movably received in the receiving space, a housing power line installed in the receiving space to extend in a movement path of the balancing unit, the housing power line coming into contact with the balancing unit, and a power supply unit to supply power to the balancing unit through the housing power line.

13 Claims, 11 Drawing Sheets

【Figure 1】
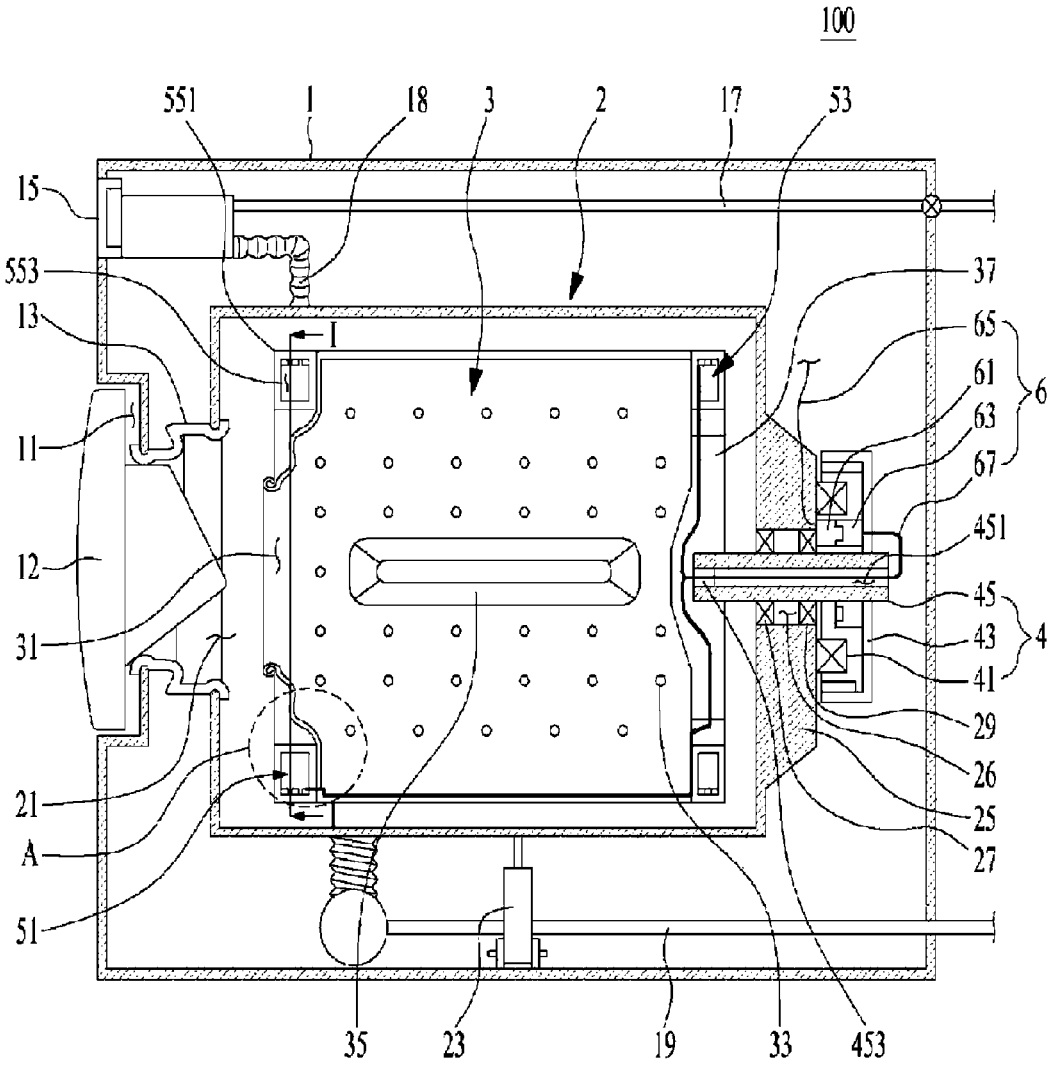

【Figure 2】
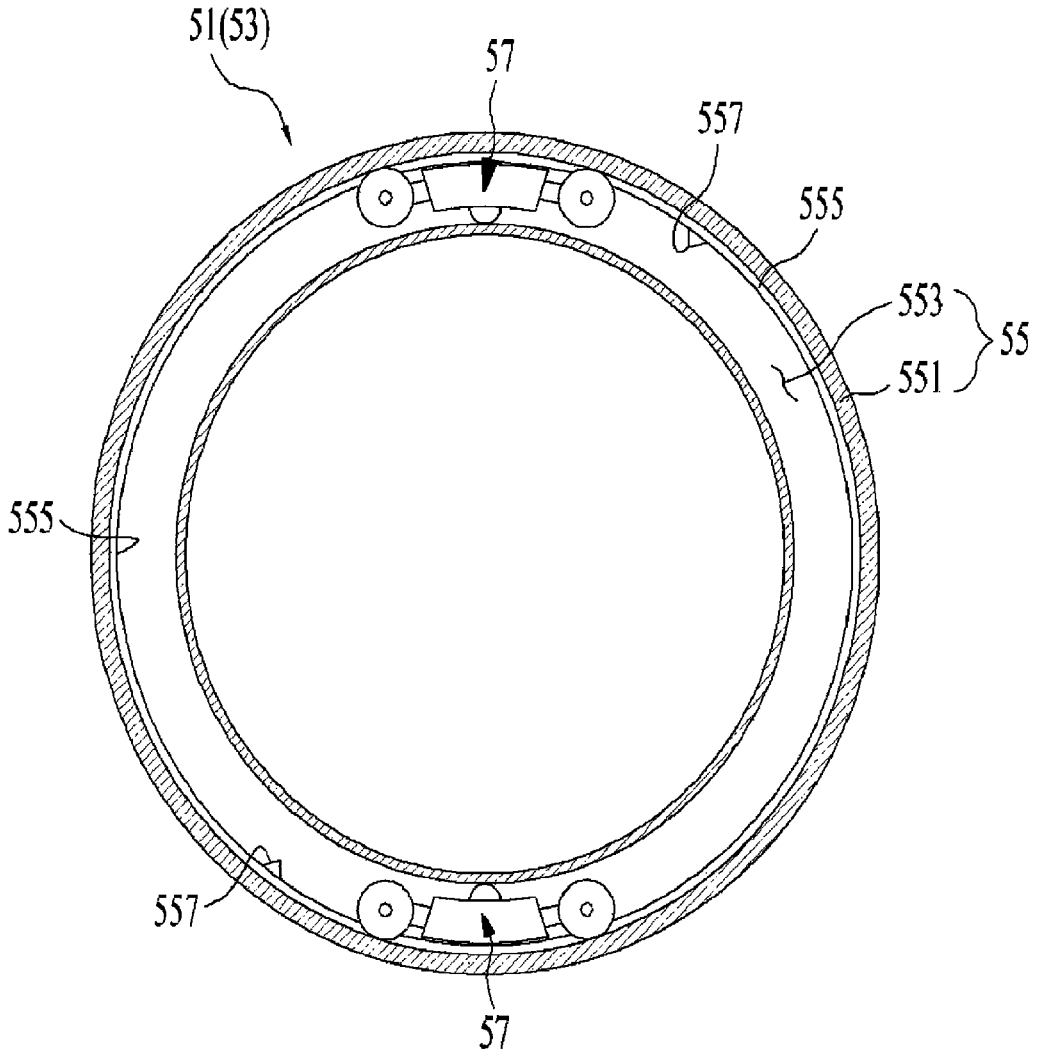

【Figure 3】
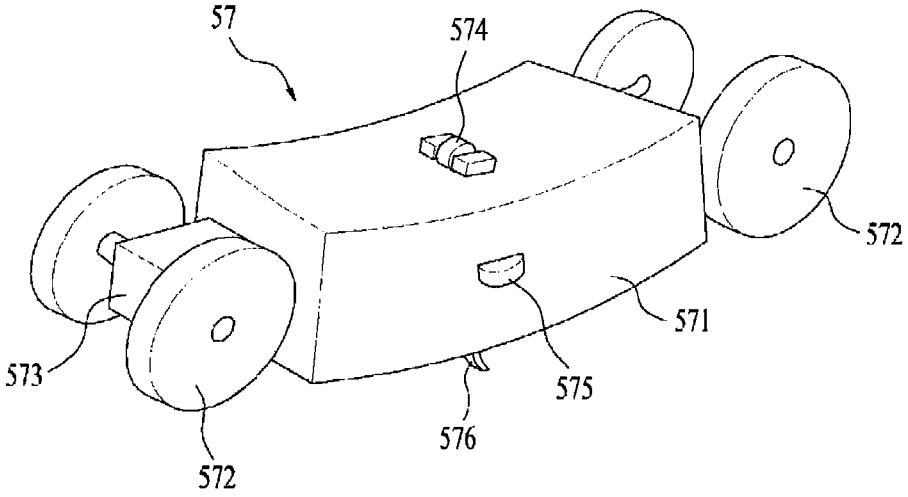
(a)
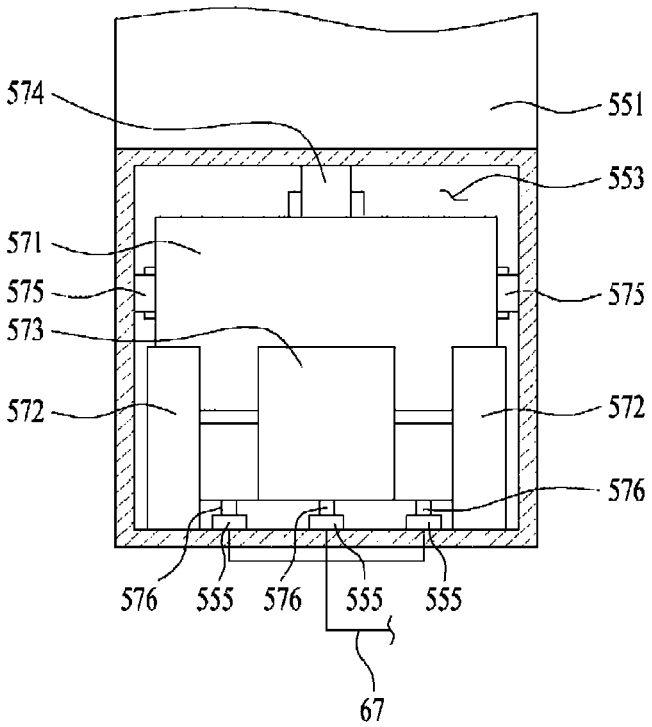
(b)

【Figure 4】
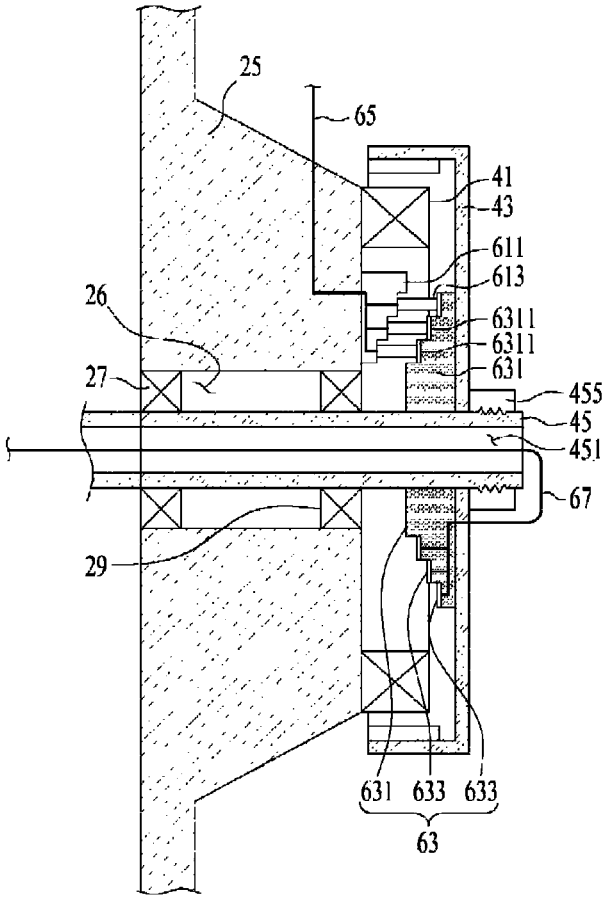
(a)
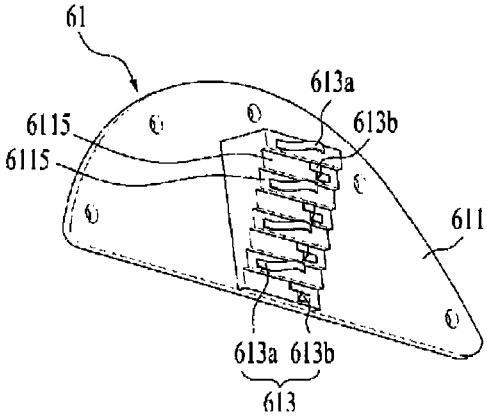
(b)
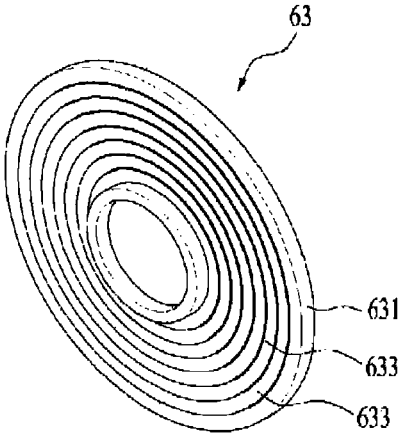
(c)

【Figure 5】
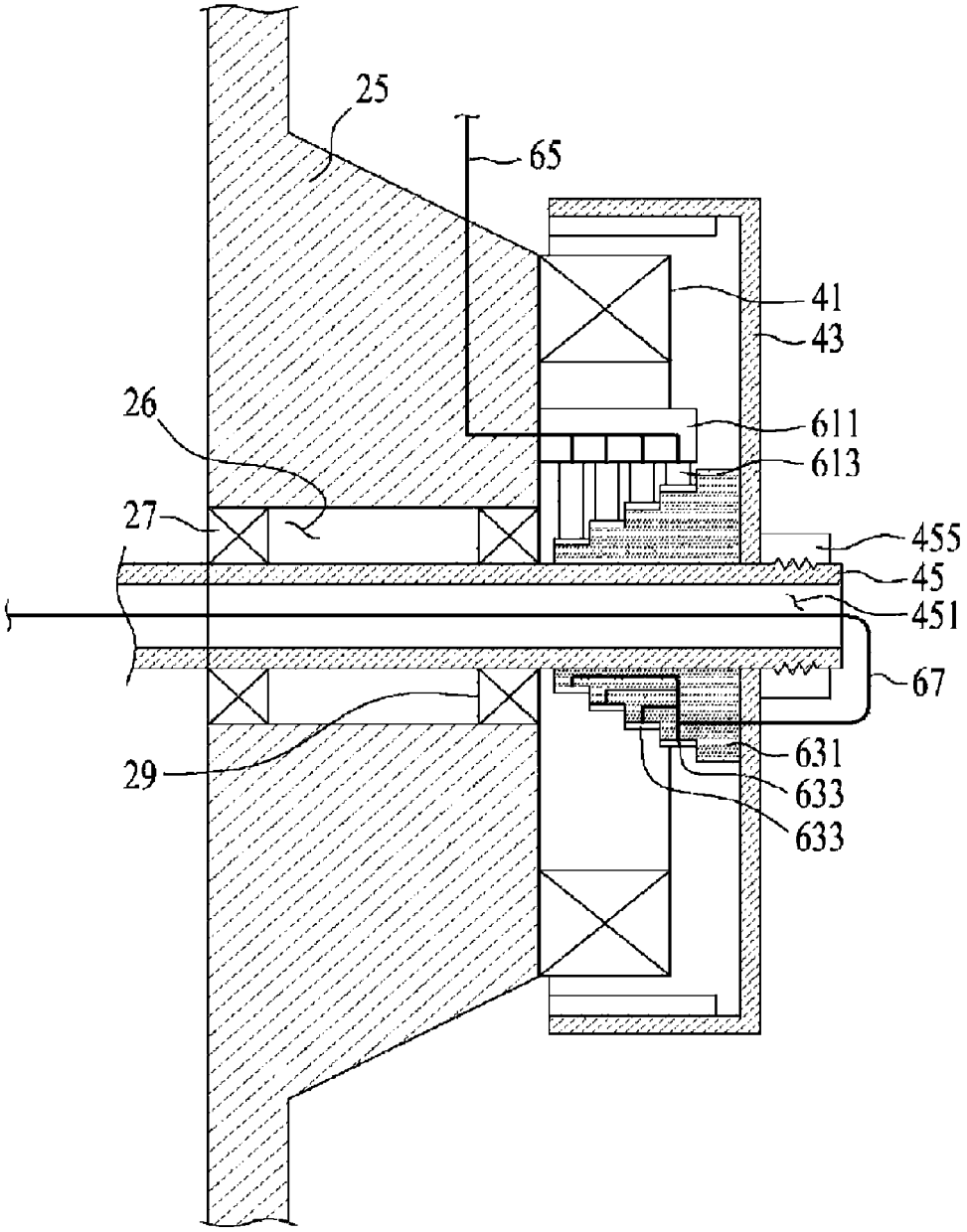

【Figure 6a】
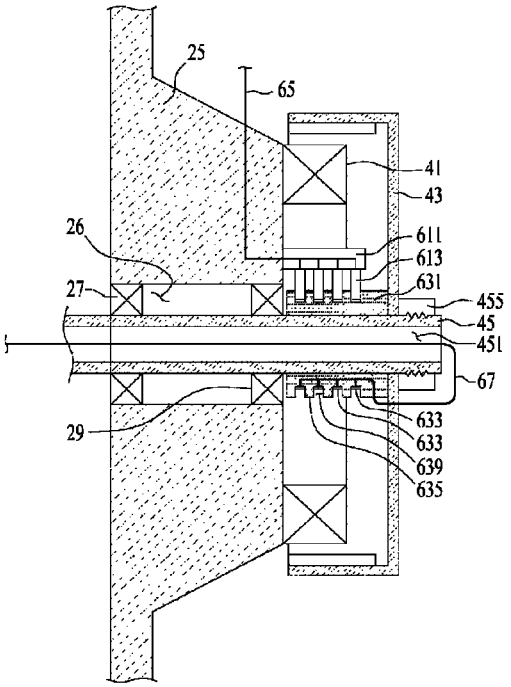
【Figure 6b】
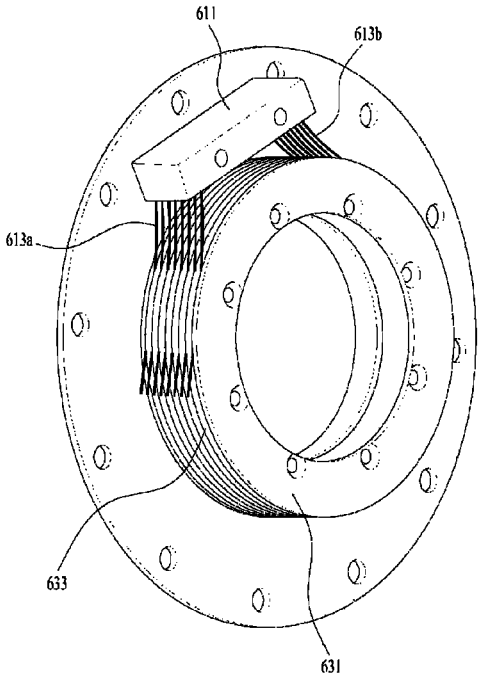

【Figure 7】
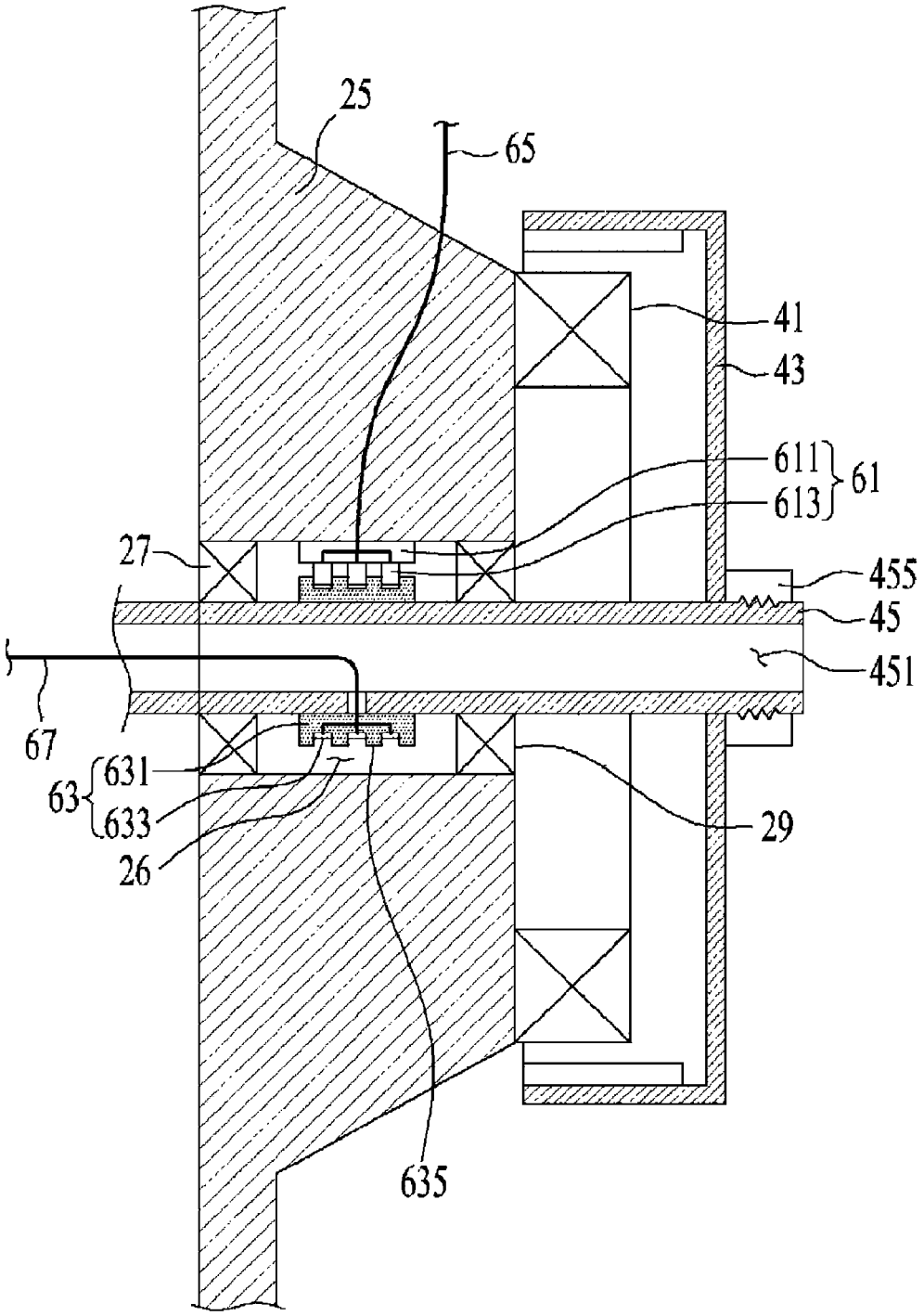

【Figure 8】
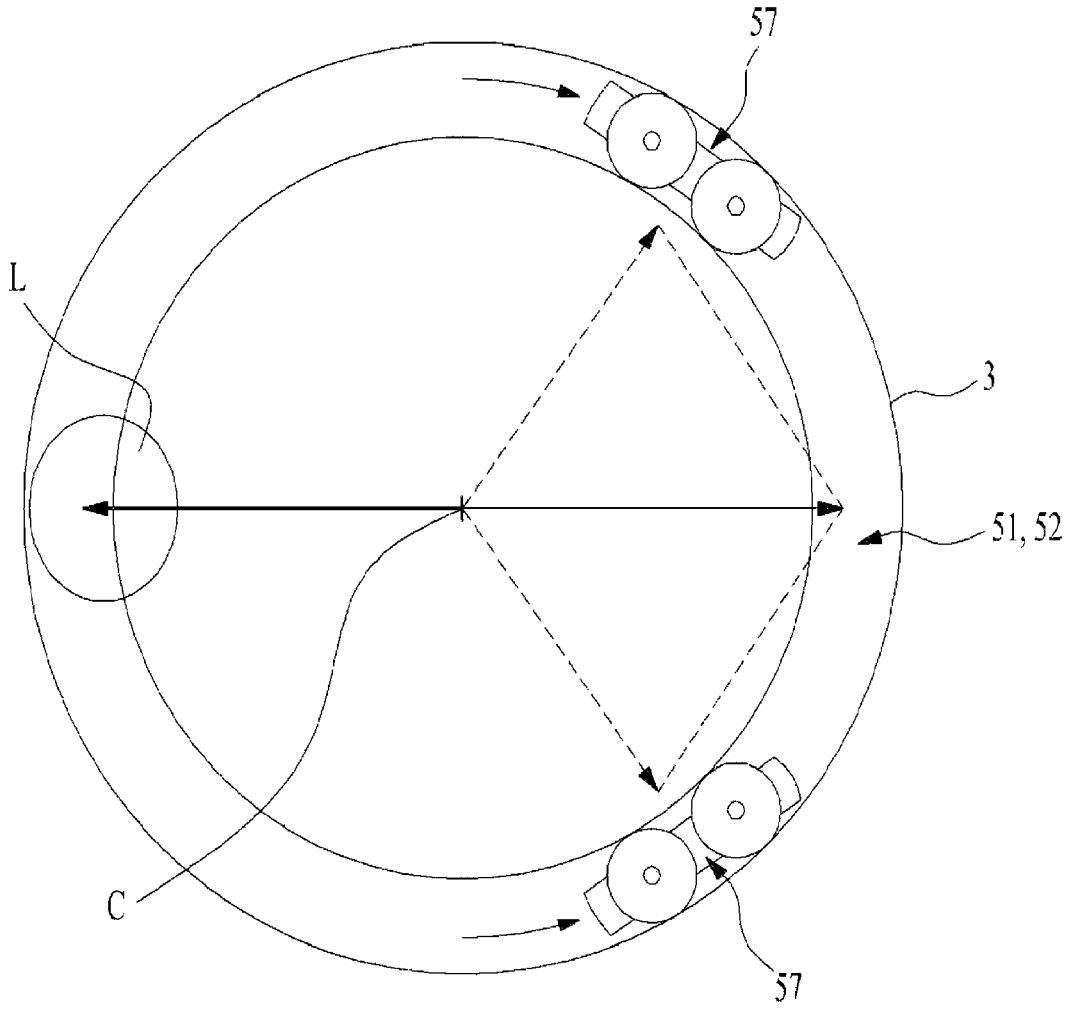

【Figure 9】
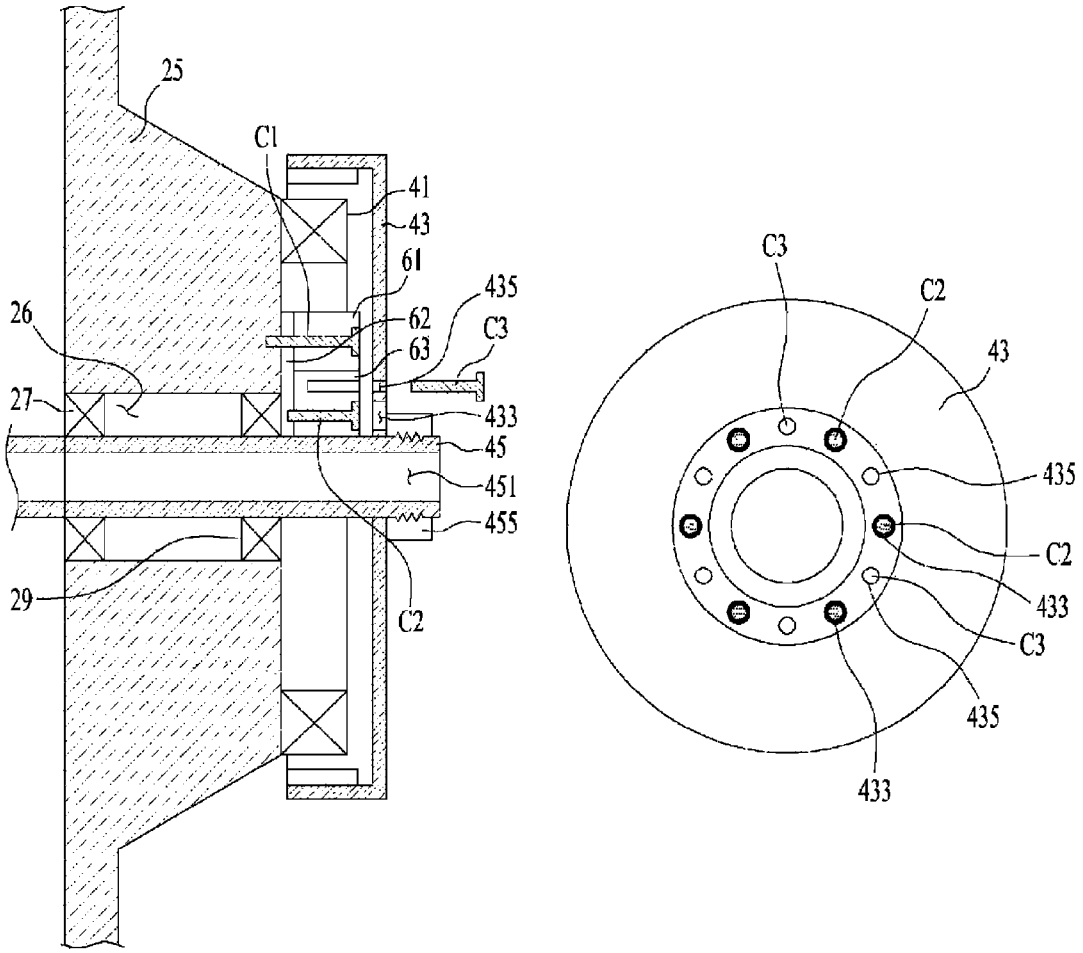
(a) (b)

【Figure 10】
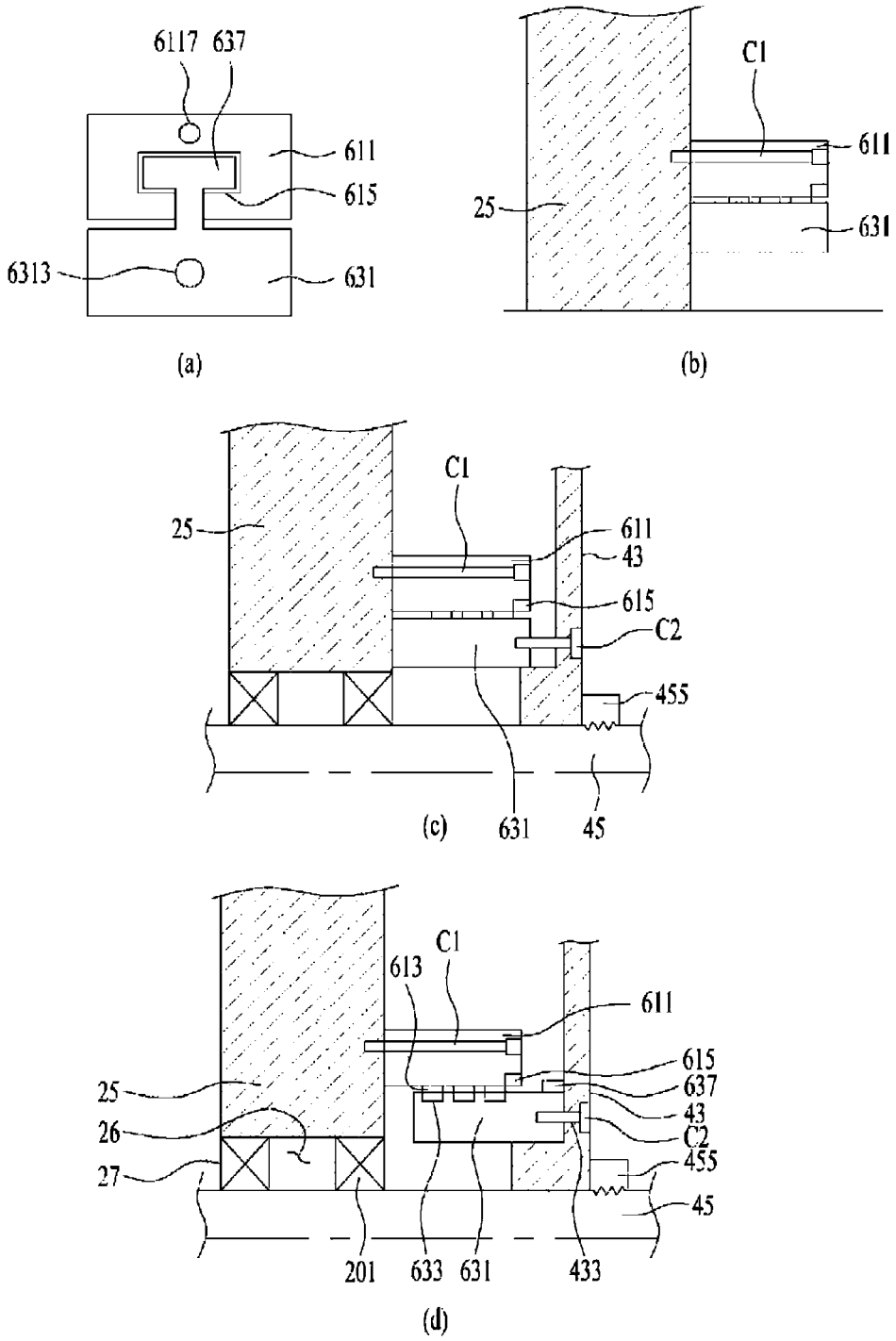

【Figure 11】
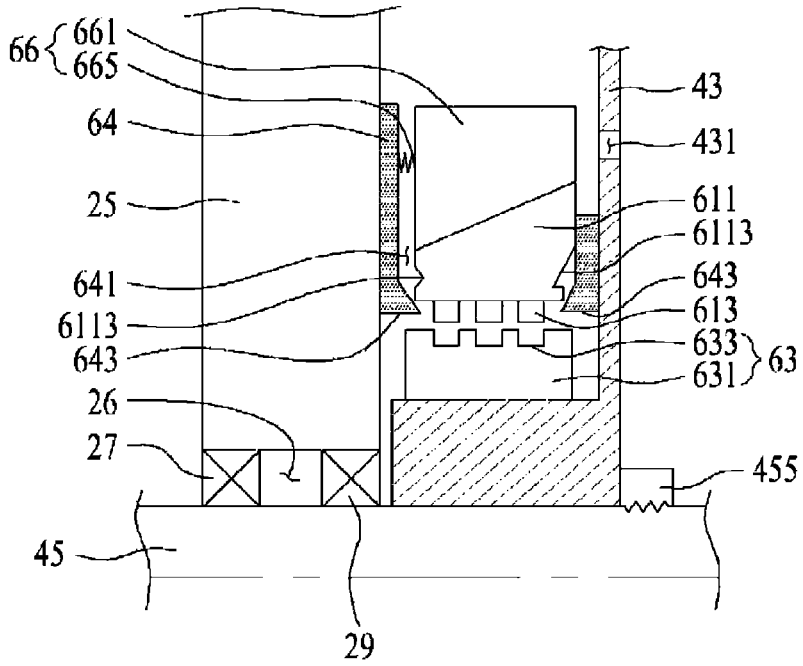
(a)
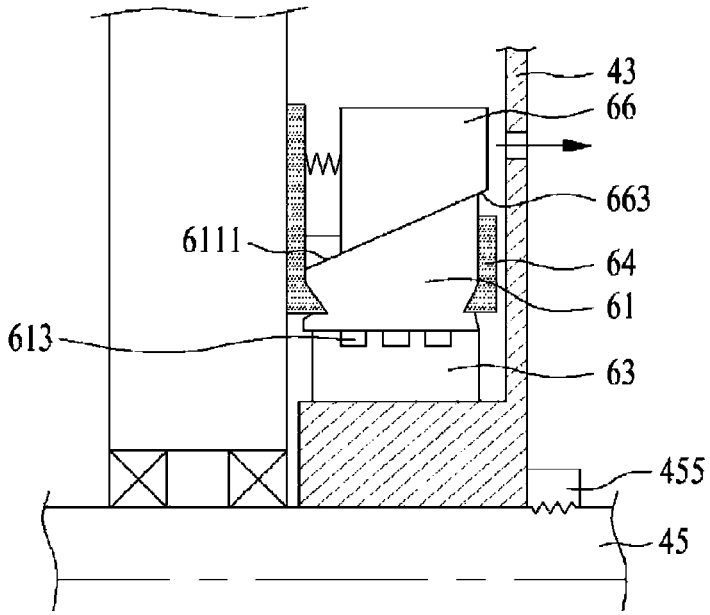
(b)

LAUNDRY TREATMENT APPARATUS

This application claims the benefit of Korean Patent Application No. 10-2013-0067878, filed on Jun. 13, 2013, which is hereby incorporated by reference as if fully set forth herein.

BACKGROUND

Field of the Invention

The present invention relates to a laundry treatment apparatus.

Discussion of the Related Art

A conventional laundry treatment apparatus includes a cabinet defining an external appearance of the laundry treatment apparatus, a tub installed within the cabinet, a drum rotatably installed within the tub, the drum serving to wash laundry therein, and a motor, a rotating shaft of which penetrates the tub and is secured to the drum to rotate the drum.

The drum may fail to maintain dynamic equilibrium or dynamic balance according to a position of laundry stored therein, which may cause unintentional rotation of the drum.

Dynamic balance refers to a state in which centrifugal force or moment of centrifugal force becomes zero with respect to a rotation axis during rotation of a rotator. In the case of a rigid body, it maintains dynamic balance when mass distribution is constant about a rotation axis thereof.

Accordingly, with regard to the aforementioned laundry treatment apparatus, dynamic balance may be understood as a case in which mass distribution of laundry stored in the drum about a rotation axis of the drum falls within an acceptable range during rotation of the drum (i.e. a case in which the drum is rotated while undergoing vibration within an acceptable range).

On the other hand, breakage of dynamic balance (i.e. unbalance) with regard to the laundry treatment apparatus may be understood as a case in which mass distribution of laundry about a rotation axis of the drum is not constant during rotation of the drum. Such unbalance occurs when laundry is not uniformly distributed in the drum.

When the drum is rotated in an unbalanced state, vibration of the drum occurs, and in turn vibration of the drum is transferred to the tub or the cabinet, causing noise.

Some conventional laundry treatment apparatuses are equipped with balancers to eliminate unbalance of the drum. These balancers provided in some conventional laundry treatment apparatuses are ball balancers or fluid balancers in which a ball or liquid is received in a balancer housing that is mounted to the drum.

The drum in an unbalanced state has a feature in that revolutions per minute of the drum reach maximum when laundry, which induces unbalance of the drum, passes the lowermost point of a drum rotation trace, and reach minimum when the unbalance inducing laundry passes the uppermost point of the drum rotation trace.

Therefore, the ball balancers or fluid balancers equipped in the conventional laundry treatment apparatuses are devised to control unbalance as the ball or fluid moves to the lowermost point of the drum rotation trace when the unbalance inducing laundry moves to the uppermost point of the drum rotation trace.

The unbalance control described above may be available under steady state vibration in which vibration of the drum falls within a constant range. However, it is impossible to anticipate great effects in a transient vibration state before vibration of the drum reaches a steady state.

In addition, the conventional balancers have a difficulty in immediately eliminating occurred unbalance (i.e. in actively eliminating unbalance).

SUMMARY

Accordingly, the present invention is directed to a laundry treatment apparatus that substantially obviates one or more problems due to limitation and disadvantages of the related art.

One object of the present invention is to provide a laundry treatment apparatus, which may actively eliminate unbalanced rotation (i.e. unbalance) of a drum in which laundry is received.

Another object of the present invention is to provide a laundry treatment apparatus equipped with a balancer, the balancer including at least two balancing units configured to move independently of each other (in different directions) within a housing secured to a drum.

A further object of the present invention is to provide a laundry treatment apparatus, which may supply power to at least two balancing units through power lines, the two balancing units being configured to move independently of each other within a housing secured to a drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the present invention, as embodied and broadly described herein, a laundry treatment apparatus includes a cabinet defining an external appearance of the laundry treatment apparatus, a drum rotatably placed in the cabinet, a balancer including a housing secured to the drum, a receiving space provided in the housing, at least one balancing unit movably received in the receiving space, and a housing power line installed in the receiving space to extend in a movement path of the balancing unit, the housing power line supplying power to the balancing unit, and a power supply unit to supply power to the housing power line.

The power supply unit may include a first supply unit configured to receive power from a power source, the first supply unit connected to a power source, a second supply unit to be rotated during rotation of the drum, wherein the second supply unit continuously comes into contact with the first supply unit during rotation thereof, and a connection line to connect the second power supply unit and the housing power line to each other.

The first supply unit may be fixed inside the cabinet.

The laundry treatment apparatus may further include a tub placed in the cabinet, the drum being received in the tub, and a drive unit including a stator secured to the tub, a rotor to be rotated via electromagnetic interaction with the stator, and a rotating shaft penetrating the tub to connect the drum and the rotor to each other.

The power supply unit may be located at the outside of the tub.

The power supply unit may include a first supply unit secured to the tub, the first supply unit connected to a power source, a second supply unit secured to the rotor or the rotating shaft, wherein the second supply unit continuously comes into contact with the first supply unit during rotation of the rotor, and a connection line to connect the second power supply unit and the housing power line to each other.

The rotating shaft may have a shaft bore perforated in the center thereof, and the connection line may be inserted into the shaft bore to connect the second supply unit and the housing power line to each other.

The rotating shaft may have a groove formed in a longitudinal direction thereof, and the connection line may be inserted in the groove to connect the second supply unit and the housing power line to each other.

The first supply unit may include a first body secured to the tub, and a first contact piece provided at the first body, wherein the first contact piece is connected to the power source, and the second supply unit may include a second body secured to the rotor or the rotating shaft, and a second contact piece provided at the second body so as to be connected to the connection line, wherein the second contact piece comes into contact with the first contact piece.

The first contact piece may protrude from the first body in a direction parallel to the rotating shaft.

The first contact piece may protrude from the first body in a direction perpendicular to the rotating shaft.

The second body may take the form of a circular column and may be provided at a circumferential surface thereof with at least two stepped portions, diameters of which increase with decreasing distance to the rotor. The second contact piece may be provided at each of the stepped portions.

The second body may take the form of a circular column having a constant diameter, and the second contact piece may be located in a recess indented in the circumferential surface of the second body.

The tub may include a bearing housing, a housing bore perforated in the bearing housing, and a first bearing and a second bearing spaced apart from each other by a given distance in the housing bore. The first and second bearings serve to support the rotating shaft. The power supply unit may include a first supply unit secured in the housing bore so as to be connected to a power source. The first supply unit being located between the first bearing and the second bearing. A second supply unit secured to the rotating shaft. The second supply unit comes into contact with the first supply unit, and a connection line to connect the second supply unit and the housing power line to each other.

The rotating shaft may have a shaft bore perforated in the center thereof, and the connection line may be inserted into the shaft bore to connect the second supply unit and the housing power line to each other.

The laundry treatment apparatus may further include a balancing unit power line installed to the balancing unit, the balancing unit power line coming into contact with the housing power line.

The housing power line may have a width equal to or greater than a width of the balancing unit power line.

The housing power line may include a plurality of lines and the balancing unit power line may be equal in number to the housing power line.

The housing power line may protrude from a surface of the housing defining the receiving space.

The housing power line may be located at one surface of the housing defining the receiving space, the surface being parallel to a lower surface of the balancing unit.

The housing power line may be additionally located at one surface of the housing defining the receiving space, the surface being parallel to a lateral surface of the balancing unit.

The laundry treatment apparatus may further include a tub placed in the cabinet, the drum being received in the tub, an arm secured to the drum, the arm extending in a diameter direction of the drum, and a drive unit including a stator secured to the tub, a rotor configured to be rotated via electromagnetic interaction with the stator, and a rotating shaft penetrating the tub to connect the arm and the rotor to each other, and the connection line may penetrate the arm and is guided to the housing power line.

The balancer may include a rear balancer secured to a rear face of the drum, the arm being located at the rear face, and a front balancer secured to a front face of the drum, and the connection line may include a front connection line connecting the housing power line of the front balancer and the second supply unit to each other and a rear connection line connecting the housing power line of the rear balancer and the second supply unit to each other.

The balancer may include a rear balancer secured to a rear face of the drum, the arm being located at the rear face, and a front balancer secured to a front face of the drum, and the connection line may include a main connection line connected to the second supply unit, a front connection line diverged from the main connection line and connected to the housing power line of the front balancer, and a rear connection line diverged from the main connection line and connected to the housing power line of the rear balancer.

The at least one balancing unit may include at least two balancing units received in the receiving space, and the respective balancing units may be movable independently of each other in the receiving space.

Each of the balancing units may include a balancing unit body located in the receiving space, a motor installed to the balancing unit body, a wheel to be rotated by the motor, the wheel serving to move the balancing unit body in the receiving space, and a balancing unit power line coming into contact with the housing power line to supply power to the motor.

The laundry treatment apparatus may further include a controller to control rotation of the drum, and a communication device to communicate with the balancing unit, each balancing unit may further include a balancing unit communication device to communicate with the communication device, and a balancing unit controller to control the motor, and the controller may control the balancing unit controller via the communication device and the balancing unit communication device, so as to move the balancing unit in a given direction for attenuation of unbalance of the drum.

The housing power line may have a projection or a folding recess configured to cause variation in the quantity of current.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiment(s) of the invention and together with the description serve to explain the principle of the invention. In the drawings:

FIG. 1 illustrates one example of a laundry treatment apparatus according to the present invention;

FIG. 2 illustrates a balancer according to the present invention;

FIG. 3 illustrates a balancing unit according to the present invention;

FIGS. 4 to 7 illustrate different embodiments of a power supply unit according to the present invention;

FIG. 8 illustrates operation of the balancing unit; and

FIGS. 9 to 11 illustrate other embodiments of the power supply unit according to the present invention.

DETAILED DESCRIPTION

Hereinafter, preferred embodiments of the present invention will be described in detail with reference to the accompanying drawings. Meanwhile, a configuration or a control method of an apparatus that will be described hereinafter is provided for explanation of the embodiments of the present invention, and is not intended to limit a technical range of the present invention. The same reference numerals of the entire specification designate the same constituent elements.

The laundry treatment apparatus, designated by reference numeral 100, includes a cabinet 1 defining an external appearance of the apparatus 100, a tub 2 placed within the cabinet 1, a drum 3 rotatably placed within the tub 2, the drum 3 being configured to receive laundry therein, and balancers 51 and 53 mounted to the drum 3 to attenuate unbalance of the drum 3.

The cabinet 1 includes an opening 11 for introduction and removal of laundry and a door 12 configured to open or close the opening 11.

The tub 2 internally defines a space for storage of wash water, and has a tub opening 21 communicating with the opening 11. A position of the tub 2 is fixed in the cabinet 1 using a tub support member 23.

The tub support member 23 serves to attenuate vibration of the tub 2. To this end, the tub support member 23 may include a damper or a spring, for example.

A gasket 13 may be interposed between the opening 11 and the tub opening 21. The gasket 13 serves to prevent wash water in the tub 2 from leaking into the cabinet 1. In addition, to prevent vibration of the tub 2 from being transferred to the cabinet 1, the gasket 13 may be formed of an elastic material.

Meanwhile, the cabinet 1 may further include a water supply pipe 17 through which wash water is supplied into the tub 2, and a drain pipe 19 through which wash water in the tub 2 is discharged to the outside of the cabinet 1.

In addition, the cabinet 1 may further include a detergent box 15 to supply detergent into the tub 2. The detergent box 15 may take the form of a drawer configured to be introduced into or withdrawn from a front face of the cabinet 1 (the front face being further provided with the opening 11).

The detergent box 15 may be connected to a water supply source (not shown) through the water supply pipe 17, and may be connected to the tub 2 through a detergent supply pipe 18. Accordingly, when wash water is supplied into the detergent box 15 through the water supply pipe 17, detergent stored in the detergent box 15 may be supplied into the tub 2 through the detergent supply pipe 18.

The drum 3 has a drum opening 31 communicating with the tub opening 21. Thus, the user may introduce laundry into the drum 3, or may remove laundry outward from the drum 3 through the opening 11, the tub opening 21, and the drum opening 31.

The drum 3 has a plurality of through-holes 33 perforated in the outer circumference thereof. This serves not only to allow wash water stored in the tub 2 to be directed into the drum 3, but also to allow water extracted from laundry to be directed into the tub 2.

Meanwhile, the drum 3 is provided at an inner circumferential surface thereof with lifters 35 to agitate laundry during rotation of the drum 3.

The drum 3 described above is rotated by a drive unit 4 installed to the exterior of the tub 2.

The drive unit 4 may include a stator 41 secured to a rear face of the tub 2, a rotor 43 configured to be rotated via interaction with a magnetic field created by the stator 41, and a rotating shaft 45 penetrating the rear face of the tub 2 to connect the drum 3 and the rotor 43 to each other.

Meanwhile, in a case in which an arm 37 configured to easily transfer torque of the rotor 43 to the drum 3 is provided at a rear face of the drum 3, it is necessary to secure the rotating shaft 45 to the arm 37.

The tub 2 may further include a bearing housing 25 configured to rotatably support the rotating shaft 45.

The bearing housing 25 may have a housing bore 26 longitudinally perforated in the bearing housing 25 to communicate the interior of the tub 2 with the exterior of the tub 2, and bearings received in the housing bore 26 to support the rotating shaft 45.

As exemplarily shown in the drawing, the bearings may include a first bearing 27 and a second bearing 29 spaced apart from each other by a given distance.

In this case, the first bearing 27 may be located in the housing bore 26 at a position proximate to the rear face of the drum 3 (i.e. at a drum side position), and the second bearing 29 may be located in the housing bore 26 at a position proximate to the drive unit 4 (i.e. at a drive side position).

Meanwhile, the drum 3 includes the balancers 51 and 53 to control vibration of the drum 3. As occasion demands, one balancer may be installed to any one of the front face and the rear face of the drum 3, or two balancers may be installed respectively to the front face and the rear face of the drum 3.

FIG. 1 illustrates a case in which the front balancer 51 is provided at the front face of the drum 3 and the rear balancer 53 is provided at the rear face of the drum 3 by way of example.

Since the front balancer 51 and the rear balancer 53 have the same inner configuration although they differ from each other in terms of positions, a balancer configuration that will be described hereinafter may be applied to each of the front balancer 51 and the rear balancer 53.

As exemplarily shown in FIG. 2, the balancer includes a housing 55 secured to the drum 3, and balancing units 57 movably received in the housing 55.

The housing 55 includes a housing body 551 secured to the drum 3, and a receiving space 553 defining an annular trace in the housing body 551.

The housing body 551 may have any shape so long as it has an opening to expose the drum opening 31. FIG. 2 shows the housing body 551 having a ring shape by way of example.

Meanwhile, although the receiving space 553 may have a perfect annular shape having a constant radius, the receiving space 553 may take the form of an imperfect annular trace (e.g., an oval trace) having a locally different radius so long as it permits movement of the balancing units 57 therein.

A housing power line 555 is installed to an inner circumferential surface of the housing body 551 defining the receiving space 553 and connected to a power supply unit 6 that will be described hereinafter. The housing power line 555 may have projections 557 or folding recesses (not shown) that cause variation in the quantity of current.

The projections 557 may have any shape to cause variation in the cross sectional area of the housing power line 555, and the folding recesses (not shown) may have any shape to cause variation in the surface angle of the housing power line 555.

The projections 557 or the folding recesses (not shown) serve to assist a controller (not shown) in sensing positions of the balancing units 57, and a detailed description thereof will follow.

According to the present invention, the balancer may include at least two balancing units 57. This ensures that the balancing units 57 effectively prevent unbalance of the drum 3. Meanwhile, the balancing units 57 may have the same basic configuration.

As exemplarily shown in (a) of FIG. 3, each of the balancing units 57 includes a unit body (balancing unit body) 571 having a size to move along the receiving space 553, a motor 573 mounted to the unit body (balancing unit body) 571, wheels 572 supporting the unit body (balancing unit body) 571, the wheels 572 being adapted to be rotated by the motor 573, and a unit power line (balancing unit power line) 576 installed to the unit body (balancing unit body) 574 to transmit power (electric energy), supplied to the housing power line 555, to the motor 573.

The wheels 572 may be installed at front and rear ends of the unit body (balancing unit body) 571, and the motor 573 may serve to rotate only front wheels or rear wheels.

Meanwhile, the unit body (balancing unit body) 571 may be provided at an upper surface and/or either lateral surface thereof with spacers to maintain a constant distance between an outer surface of the unit body (balancing unit body) 571 and an inner surface of the housing body 551 defining the receiving space 553.

In (b) of FIG. 3, a case in which the spacers include a first auxiliary wheel 574 provided at the upper surface of the unit body (balancing unit body) 571 and second auxiliary wheels 575 provided respectively at opposite lateral surfaces of the unit body (balancing unit body) 571 is illustrated by way of example.

In this case, the housing power line 555 may be mounted in the receiving space 553 so as to be located below the unit body (balancing unit body) 571, or may be mounted in the receiving space 553 so as to be located at opposite lateral sides of the unit body (balancing unit body) 571.

The first auxiliary wheel 574 and the second auxiliary wheels 575 are rotatably installed to the unit body (balancing unit body) 571.

The unit power line (balancing unit power line) 576 is secured to the unit body (balancing unit body) 571 to come into contact with the housing power line 555. Thus, the unit power line 576 may continuously come into contact with the housing power line 555 regardless of a position of the balancing unit 57 in the receiving space 553 (i.e. even if the balancing unit 57 moves in the receiving space 573).

Accordingly, the balancing unit 57, which moves in the receiving space 553 of the housing 55, may receive power from the housing power line 555 through the unit power line (balancing unit power line) 576.

Moreover, the housing power line 555 may have a width equal to or greater than a width of the unit power line 576. In addition, a plurality of housing power lines may be provided and the unit power line may be equal in number to the housing power lines.

Meanwhile, the balancing unit 57 according to the present invention may further include a unit controller (not shown, a balancing unit controller) to control operation of the motor 573, and a unit communication device (not shown, a balancing unit communication unit) for data transmission and reception.

In this case, the laundry treatment apparatus 100 of the present invention may further include a controller (not shown) to control the drive unit 4 or to control supply and drainage of wash water (to control opening/closing of the water supply pipe 17 or opening/closing of the drain pipe 19), and a communication device (not shown) for data interchange with the unit communication device (not shown).

Accordingly, when unbalance of the drum occurs, the controller (not shown) may transmit control data, required to move the balancing unit 57 to an unbalance attenuation position, to the unit communication device (not shown) through the communication device (not shown), and the unit controller (not shown) may move the balancing unit 57 to a specific position (i.e. an unbalance attenuation position) based on the control data received by the unit communication device, so as to attenuate unbalance of the drum 3.

As exemplarily shown in FIG. 1, the power supply unit 6 to supply power to the housing power line 555 may include a first supply unit 61 connected to a power source (a power supply source), a second supply unit 63 adapted to be rotated along with the drum 3 while continuously coming into contact with the first supply unit 61, and a connection line 67 connecting the second supply unit 63 and the housing power line 555 to each other.

The first supply unit 61 may be fixed at any inner position of the cabinet 1 so long as the first supply unit 61 is not rotated along with the drum 3. The second supply unit 63 may be fixed at any inner position of the cabinet 1 so long as the second supply unit 63 is rotated along with the drum 3 and comes into contact with the first supply unit 61.

FIG. 1 illustrates a case in which the second supply unit 63 is secured to the rotor 43 or the rotating shaft 45 so as to be rotated along with the drum 3 and the first supply unit 61 is secured to the bearing housing 25 so as to continuously come into contact with the second supply unit 63 by way of example.

In this case, the first supply unit 61 is connected to a power source (not shown) that supplies power to the laundry treatment apparatus 100 through a power connection line 65.

Meanwhile, the connection line 67, which connects the second supply unit 63 and the housing power line 555 to each other, penetrates the rear face of the tub 2 through a shaft bore 451 longitudinally formed in the rotating shaft 45.

The connection line 67, having penetrated the rear face of the tub 2 through the shaft bore 451, may be secured to the inner circumferential surface or outer circumferential surface of the drum 3 and then be connected to the housing power line 555 of the housing 55.

In the case exemplarily shown in FIG. 1, for example, the connection line 67 extending to the front balancer 51 may be secured to the inner circumferential surface of the drum 3, and the connection line 67 extending to the rear balancer 53 may be secured to the outer circumferential surface of the drum 3.

In any case, it is necessary to protect the connection line 67 from wash water stored in the tub 2, and therefore the drum 3 may further include an insulator (not shown) to prevent contact between the connection line 67 and the wash water.

Meanwhile, the connection line 67 may be comprised of two separate connection lines, i.e. a front connection line that connects the housing power line 555 of the front balancer 51 and the second supply unit 63 to each other and a rear connection line that connects the housing power line 555 of the rear balancer 53 and the second supply unit 63 to each other.

In addition, the connection line 67 may be comprised of a main connection line that is connected to the second supply unit 63, a front connection line that is diverged from the main connection line and connected to the housing power line 555 of the front balancer 51, and a rear connection line that is diverged from the main connection line and connected to the housing power line 555 of the rear balancer 53.

The rotating shaft 45 may be provided with a seal 453 to prevent wash water stored in the tub 2 from entering the shaft bore 451.

Meanwhile, differently from the above description, the rotating shaft 45 may have a groove formed in a longitudinal direction thereof and the connection line 67 may be inserted in the groove so as to penetrate the rear face of the tub 2.

In the laundry treatment apparatus 100 having the above described configuration, since the rotating shaft 45 and the rotor 43 are rotated along with the drum 3, there is no risk of entanglement of the connection line 67 even if the second supply unit 63 is rotated along with the rotor 43.

Accordingly, the present invention enables wired power supply to the balancing unit 57 through the connection line 67 to allow the balancing unit 57 to move in the balancer that is rotated along with the drum 3.

Although the above embodiment has been described on the basis of the laundry treatment apparatus 100 having a laundry washing function, the present invention may be applied to a laundry treatment apparatus having a drying function only.

More specifically, the laundry treatment apparatus having a drying function only may not include the tub 2 described above. In this case, so long as the second supply unit 63 is secured so as to be exposed outward of the rotor 43 and the first supply unit 61 is secured to the cabinet 1 so as to continuously come into contact with the second supply unit 63, the same effects as in the above description may be achieved.

FIG. 4 shows one embodiment of the power supply unit 6 included in the laundry treatment apparatus 100 of the present invention.

The first supply unit 61 according to the present embodiment includes a first body 611 mounted to the bearing housing 25 and first contact pieces (i.e. conductors) 613 arranged at the first body 611, the first contact pieces 613 being connected to the power connection line 65. The second supply unit 63 includes a second body 631 mounted to the rotor 43 or the rotating shaft 45 and second contact pieces (i.e. conductors) 633 arranged at the second body 631 to come into contact with the first contact pieces 613 respectively.

As exemplarily shown in (b) of FIG. 4, the first body 611 may include multiple stepped portions 6115, heights of which are increased with increasing distance from the rotating shaft 45 or decreasing distance to the stator 41.

In this case, the first contact pieces 613 protrude from the first body 611 toward the second contact pieces 633 in a direction parallel to the rotating shaft 45. The respective contact pieces 613 are separated from one another by the respective stepped portions 6115.

The first contact pieces 613 may include forward contact pieces 613*a*, right ends of which are free ends, and left ends of which are secured to the first body 611, and reverse contact pieces 613*b*, left ends of which are free ends, and right ends of which are secured to the first body 611.

This serves to ensure stable contact between the first contact pieces 613 and the second contact pieces 633 even if a rotating direction of the rotor 43 is changed. In (b) of FIG. 4, a case in which the forward contact pieces 613*a* and the reverse contact pieces 613*b* are alternately arranged is illustrated by way of example.

Meanwhile, the second body 631 may take the form of a circular column having a center body bore.

In this case, the rotating shaft 45 may be inserted into the body bore of the second body 631, and the second body 631 may be mounted to at least one of the rotor 43 and the rotating shaft 45.

Moreover, the second body 631 may include multiple stepped portions 6311, heights of which are reduced with increasing distance from the rotating shaft 45. That is, the stepped portions 6311 of the second body 631 may be shaped to be engaged with the stepped portions 6115 of the first body 611.

In this case, the second contact pieces 633 are connected to the connection line 67 and are separated from one another by the respective stepped portions 6311.

Meanwhile, the connection line 67, which is electrically connected to the second contact pieces 633, may first be withdrawn outward of the rotor 43 through a rotor through-hole (431, e.g., a heat radiation hole) of the rotor 43, and thereafter may be inserted into the shaft bore 451.

The reason why the first body 611 and the second body 631 have the stepped portions 6115 and 6311 and the respective stepped portions 6115 and 6311 are provided with the first contact pieces 613 and the second contact pieces 633 is to stably maintain contact between the first contact pieces 613 and the second contact pieces 633 during vibration of the drum 3.

Although the above embodiment has described a case in which the first contact pieces 613 protrude from the first body 611 to come into contact with the second contact pieces 633, differently, the second contact pieces 633 may protrude from the second body 631 to come into contact with the first contact pieces 613.

FIG. 5 shows another embodiment of the power supply unit 6 according to the present invention. Differently from that of the embodiment as exemplarily shown in FIG. 4, in the power supply unit 6 according to the present embodiment, the first contact pieces 613 extend in a direction perpendicular to the rotating shaft 45.

More specifically, the first body 611 may be mounted to the bearing housing 25 to protrude toward the rotor 43, and the first contact pieces 613 may protrude from the first body 611 in a direction perpendicular to the rotating shaft 45.

Even in the case of the present embodiment, the first contact pieces 613 may include forward contact pieces and reverse contact pieces, which are alternately arranged (see (b) in FIG. 4).

The second body 631 may take the form of a cylindrical column mounted to at least one of the rotating shaft 45 and the rotor 43. The second body 631 may include stepped portions, diameters of which are increased with increasing distance from the bearing housing 25 or decreasing distance to the rotor 43.

In this case, the second contact pieces 633 may be secured to the first body 631 so as to be separated from one anther by the stepped portions.

In the case of the present embodiment, likewise, the first contact pieces 613 may be secured to the surface of the first body 611, and the second contact pieces 633 may protrude from the second body 631 so as to be connected to the first contact pieces 613.

FIGS. 6A and 6B show another embodiment of the power supply unit 6 according to the present invention. The second supply unit 63 according to the present embodiment has a feature in that barriers 635 are located between the respective neighboring second contact pieces 633 to prevent the first contact pieces 613 from being separated from the second contact pieces 633 during vibration of the drum 3.

In a case in which the second contact pieces 633 are secured to the circumferential surface of the second body 631, the barriers 635 may protrude from the circumferential surface of the second body 631 so as to be located between the respective neighboring second contact pieces 633.

Alternatively, in a case in which recesses 639, in which the second contact pieces 633 are received, are indented in the circumferential surface of the second body 631, the barriers 635 may be portions of the second body 631 located between the respective neighboring second contact pieces 633.

The first contact pieces 613 may include forward contact pieces and reverse contact pieces, which have a configuration as exemplarily shown in (b) of FIG. 4, or may include forward contact pieces and reverse contact pieces, which have a configuration as exemplarily shown in FIG. 6B.

Referring to FIG. 6B, the first contact pieces 613 according to the present embodiment may include forward contact pieces 613*a* and reverse contact pieces 613*b*, which protrude from the first body 611 in different directions (note that the first contact pieces of FIGS. 4 and 5 may have the configuration of FIG. 6B).

FIG. 7 shows a further embodiment having a feature in that the power supply unit 6 is located in the bearing housing 25.

More specifically, the first supply unit 61 according to the present embodiment is mounted in the housing bore 26 and the second supply unit 63 is mounted to the rotating shaft 45 so as to come into contact with the first supply unit 61.

In this case, the first body 611 may be fixed in a space defined between the first bearing 27 and the second bearing 29, and the first contact pieces 613 may be secured to the first body 611 so as to protrude in a direction perpendicular to the rotating shaft 45, the first contact pieces 613 being connected to the power connection line 65.

In addition, the second body 631 mounted to the rotating shaft 45 may include the second contact pieces 633, which are arranged to come into contact with the first contact pieces 613 and connected to the connection line 67, and the barriers 635 located between the respective neighboring second contact pieces 633, the barriers 635 being configured to receive the first contact pieces 613 therein.

Meanwhile, although FIGS. 4 to 7 illustrate that the first supply unit 61 is mounted to the tub 2 and the second supply unit 63 is mounted to the rotor 43 or the rotating shaft 45, a mounting configuration of the power supply unit 6 may be altered in such a way that the first supply unit 61 is mounted to the rotating shaft 45 or the rotor 43 and the second supply unit 63 is mounted to the tub 2.

However, in the case in which the first supply unit 61 is mounted to the rotor 43 or the rotating shaft 45 or the second supply unit 63 is mounted to the rear face of the tub 2, it is noted that the power connection line 65 must be connected to the second contact pieces 633 and the connection line 67 must be connected to the first contact pieces 613.

FIG. 8 shows an unbalance control (vibration control) process of the laundry treatment apparatus 100 having the above described configuration.

When laundry L is not uniformly distributed at the inner circumferential surface of the drum 3 and gathered in a partial region of the drum 3, the drum 3 enters an unbalanced state in which the drum 3 is rotated while undergoing vibration beyond an acceptable vibration range.

Whether or not the drum 3 is in the unbalanced state may be judged in various ways. In one example, a controller (not shown) may judge whether or not the drum 3 is in the unbalanced state by sensing revolutions per minute of the rotor 43 (i.e. by receiving data regarding revolutions per minute of the rotor 43 from an RPM sensing device).

The drum in an unbalanced state has a feature in that revolutions per minute of the drum reach maximum when laundry, which induces unbalance of the drum, passes the lowermost point of a drum rotation trace, and reach minimum when the unbalance inducing laundry passes the uppermost point of the drum rotation trace.

Accordingly, the laundry treatment apparatus, which is adapted to judge whether or not the drum is in the unbalanced state using the sensing device to sense revolutions per minute of the rotor 43, may also judge a position of laundry that induces unbalance of the drum.

Meanwhile, upon judging whether or not the drum 3 is in the unbalanced state and sensing a position of laundry that induces unbalance of the drum 3, the controller (not shown) implements transmission (more particularly, wireless transmission) of control data (control instructions), required to move the balancing unit 57 to an unbalance attenuation position, to the balancing unit 57 via the communication device (not shown) and the unit communication device (not shown).

More specifically, as exemplarily shown in FIG. 8, the unit controller (not shown, the balancing unit controller) moves each balancing unit 57 such that the sum of force generated by the weight of each balancing unit 57 may attenuate (offset) force caused by laundry (in other words, each balancing unit 57 is moved such that the direction of force generated by the weight of each balancing unit 57 is opposite to a position of laundry that induces unbalance of the drum 3).

As described above, power required to move the balancing unit 57 is supplied by the power supply unit 6, the housing power line 555, and the unit power line (balancing unit power line) 576.

More specifically, the power connection line 65 supplies power to the first contact pieces 613 provided at the first supply unit 61, and in turn the first contact pieces 613 transmit power to the second contact pieces 633 of the second supply unit 63 that is rotated along with the drum 3.

Then, the second contact pieces 633 supply power to the housing power line 555 inside the receiving space 553 of the balancer through the connection line 67. Since the balancing units 57 are kept connected to the housing power line 555 through the unit power line (balancing unit power line) 576 even during movement thereof, the present invention may achieve stable supply of power to the respective balancing units 57.

In particular, since the first supply unit 61 includes the forward contact pieces 613*a* and the reverse contact pieces 613*b*, and the second supply unit 63 includes the barriers 635 to prevent separation of the first contact pieces 613 from the second contact pieces 633, even if the drum 3 vibrates due to unbalance, power may be stably supplied to the respective balancing units 57.

Meanwhile, the controller (not shown) or the unit controller (not shown) may need to judge a current position of each balancing unit 57, in order to control a movement distance or a movement direction of the balancing unit 57. In the present invention, the controller (not shown) may judge a current position of the balancing unit 57 based on the projections 557 or the folding recesses (not shown) of the housing power line 555.

Current moving along a conductor undergoes variation in magnitude at a transformed portion of the conductor. Accordingly, as the unit controller (not shown) measures the magnitude of current to be supplied to the motor 573 and transmits the measured result to the controller (not shown), the controller (not shown) may judge a position of each balancing unit 57.

In particular, in a case in which the housing power line 555 has two projections 557 or folding recesses spaced apart from each other (by 180 degrees), the controller (not shown) may judge a position of each balancing unit 57 by moving the balancing unit 57 to each projection 557 whenever an unbalance situation ends (i.e. whenever rotation of the drum 3 stops).

That is, since each balancing unit 57 will be located at each projection 557 while the laundry treatment apparatus 100 is not operated, the controller (not shown) may judge a movement direction and a movement distance of the balancing unit 57 required to attenuate unbalance when the drum 3 enters an unbalanced state during rotation thereof.

In addition, to prevent the balancing unit 57 from causing unbalance when the drum 3 is again rotated after an unbalance situation ends (i.e. rotation of the drum 3 stops), the controller (not shown) moves each balancing unit 57 to an initial position (i.e. a position of the projection 557) after the unbalance situation ends.

In this way, even if rotation of the drum 3 resumes and the drum again enters the unbalanced state after one unbalance situation ends, the controller (not shown) may calculate a movement direction and a movement distance of the balancing unit 57.

Meanwhile, the housing power line 555 may have a plurality of projections 557 (or folding recesses), and the respective projections 557 may be set to different magnitudes of current.

In this case, the controller (not shown) does not need to move each balancing unit 57 to an initial position thereof whenever unbalance control is completed (i.e. whenever rotation of the drum 3 stops), but needs to move each balancing unit 57 such that a distance between the balancing units 57 is constant.

More specifically, in a case in which the balancer includes two balancing units 57, the controller (not shown) needs to move the respective balancing units 57 such that the two balancing units 57 are spaced apart from each other by 180 degrees whenever unbalance control is completed. In a case in which the balancer includes three balancing units 57, the controller (not shown) needs to move the respective balancing units 57 such that the three balancing units 57 are spaced apart from each other by 120 degrees whenever unbalance control is completed.

FIGS. 9 to 11 illustrate other embodiments of the power supply unit 6 according to the present invention. The power supply unit 6 according to these embodiments has a feature in that the power supply unit 6 may be easily assembled with the tub 2 and the rotor 43.

The power supply unit 6 as exemplarily shown in FIG. 9 has a feature in that the power supply unit 6 further includes a coupling plate 62 (i.e. a temporary assembly plate) to couple the first supply unit 61 and the second supply unit 63 to each other.

In this case, the first supply unit 61 and the coupling plate 62 are fastened to the rear face of the tub 2 (or the bearing housing 25) via a first bolt C1, and the second supply unit 63 is fastened to the coupling plate 62 via second bolts C2.

The first supply unit 61 has a first bolt through-hole perforated in the first body 611, and the first bolt C1 is inserted into the first bolt through-hole to fasten the first supply unit 61 and the coupling plate 62 to the rear face of the tub 2.

The second supply unit 63 has second bolt through-holes and third bolt through-holes perforated in the second body 631, and the second bolts C2 are inserted into the second bolt through-holes to fasten the second supply unit 63 to the coupling plate 62.

Meanwhile, the rotor 43 has first holes 433 perforated therein to communicate with the second bolt through-holes, and second holes 435 perforated therein to communicate with the third bolt through-holes.

The second bolt through-holes and the third bolt through-holes may be alternately arranged, and therefore the first holes 433 and the second holes 435 may be alternately arranged.

An assembly process of the power supply unit 6 having the above described configuration is as follows.

After fastening the power supply unit 6 to the rear face of the tub 2 by inserting the first bolt C1 into the first bolt through-hole, a worker couples the rotor 43 to the rotating shaft 45 via a shaft fixing portion 455.

Thereafter, the worker separates the second supply unit 63 from the coupling plate 62 by inserting the third bolts C3 into the second holes 435 and rotating the second bolts C2 through the first holes 433. In this way, the first supply unit 61 is kept fastened to the rear face of the tub 2 via the first bolt C1, whereas the second supply unit 63 is fastened to the rotor 43 via the third bolts C3.

FIG. 10 shows a feature in that the first supply unit 61 further includes a first bolt through-hole 6117 perforated in the first body 611 and an engagement recess 615, and the second supply unit 63 further includes a second bolt through-hole 6313 perforated in the second body 631 and an engagement protrusion 637 to be inserted into the engagement recess 615.

In this case, the rotor 43 further has the first hole 433 perforated therein to communicate with the second bolt through-hole 6313.

The power supply unit 6 having the above described configuration maintains a coupled state of the first supply unit 61 and the second supply unit 63 as the engagement protrusion 637 is inserted into the engagement recess 615.

Once the first supply unit 61 and the second supply unit 63 has been coupled to each other, the worker may fasten the power supply unit 6 to the rear face of the tub 2 by inserting the first bolt C1 through the first bolt through-hole 6117 (see (b) of FIG. 10).

Once the power supply unit 6 has been fastened to the tub 2, the worker couples the rotor 43 to the rotating shaft 45 via the shaft fixing portion 455.

Once the rotor 43 has been coupled, the worker moves the second supply unit 63 toward the rotor 43 by inserting the second bolt C2 through the first hole 433 and the second bolt through-hole 6313 (see (c) of FIG. 10), thereby fastening the second supply unit 63 to the rotor 43 (see (d) of FIG. 10).

The engagement protrusion 637 and the engagement recess 615 serve to guide movement of the second supply unit 63 while the second supply unit 63 is fastened to the rotor 43. This may prevent the first contact pieces 613 and the second contact pieces 633 from deviating from each other, and enable adjustment in the contact area of the first contact pieces 613 and the second contact pieces 633.

FIG. 11 shows a feature in that the power supply unit 6 further includes a body support member 64 provided at the rear face of the tub 2, the body support member 64 being configured to receive the first supply unit 61 therein, and a body transfer member 66 received in the body support member 64, the body transfer member 66 serving to move the first supply unit 61 toward the second supply unit 63.

The body support member 64 is secured to the rear face of the tub 2 at a position above the second supply unit 63. The body support member 64 has a support member bore 641 in which the first body 611 of the first supply unit 61 is received.

The support member bore 641 has a body fixing ridge 643 configured to be fitted into a receiving groove 6113 formed in an outer circumferential surface of the first body 611.

The body transfer member 66 may include a transfer member body 661 inserted into the support member bore 641 so as to be located above the first body 611, and an elastic support piece 665 to connect the transfer member body 661 and the body support member 64 to each other.

Meanwhile, the transfer member body 661 has a slope 663 having an inclination angle corresponding to that of a slope 6111 of the first body 611.

An assembly process of the power supply unit 6 described above is as follows.

In a state in which the first supply unit 61 and the body transfer member 66 are inserted into the support member bore 641, the worker secures the body support member 64 to the rear face of the tub 2 (see (a) of FIG. 11).

Thereafter, the worker couples the second supply unit 63 to the rotor 43 and then couples the rotor 43 to the rotating shaft 45. Once the rotor 43 has been coupled to the rotating shaft 45, the worker moves the body transfer member 66 so as to move the first supply unit 61 to the second supply unit 63.

As the first supply unit 61 is moved downward from the support member bore 641 of the body support member 64 until the body fixing ridge 643 is fitted into the receiving groove 6113 of the first body 611, the position of the first supply unit 61 is fixed (see (b) of FIG. 11).

Meanwhile, once the position of the first body 61 has been fixed, the first contact pieces 613 are kept in contact with the second contact pieces 633. Then, the body transfer member 66 returns to an initial position thereof by the elastic support piece 665. (see (a) of FIG. 11).

The body transfer member 66 may be moved via various methods.

That is, in a case in which the slope 6111 of the first supply unit 61 is tilted upward to the rotor 43 (in other words, in a case in which the slope 663 of the body transfer member 66 is tilted upward to the rotor 43), the body transfer member 66 must be moved toward the rotor 43 to move the first supply unit 61 toward the second supply unit 63.

Accordingly, in the above described case, the body transfer member 66 may further include a wire (not shown) connected to the transfer member body 661. This serves to allow the worker to move the transfer member body 661 toward the rotor 43 by pulling the wire through the rotor through-hole 431.

Meanwhile, although not shown, in a case in which the slope 6111 of the first supply unit 61 is tilted downward to the rotor 43, the body transfer member 66 must be moved toward the rear face of the tub 2 to move the first supply unit 61 to the second supply unit 63.

In the above described case, the worker may move the first supply unit 61 toward the second supply unit 63 by inserting a bar having a given length into the rotor through-hole 431 and, then pushing the transfer member body 661 toward the rear face of the tub 2.

As is apparent from the above description, the present invention has the effect of providing a laundry treatment apparatus which may actively eliminate unbalanced rotation (i.e. unbalance) of a drum in which laundry is received.

Further, the present invention has the effect of providing a laundry treatment apparatus equipped with a balancer, the balancer including at least two balancing units configured to move independently of each other (in different directions) within a housing secured to a drum.

Furthermore, the present invention has the effect of providing a laundry treatment apparatus, which may supply power to at least two balancing units through power lines, the two balancing units being configured to move independently of each other within a housing secured to a drum.

It will be apparent that, although the preferred embodiments have been shown and described above, the invention is not limited to the above-described specific embodiments, and various modifications and variations can be made by those skilled in the art without departing from the gist of the appended claims.

What is claimed is:

1. A laundry treatment apparatus comprising:

a cabinet defining an external appearance of the laundry treatment apparatus;

a tub placed in the cabinet;

a drum rotatably placed in the tub;

a drive unit including a stator secured to the tub, a rotor to be rotated via electromagnetic interaction with the stator, and a rotating shaft penetrating the tub to connect the drum and the rotor to each other;

a bearing housing configured to rotatably support the rotating shaft;

a balancer including a housing secured to the drum, a receiving space provided in the housing, at least one balancing unit movably received in the receiving space, and a housing power line installed in the receiving space to extend in a movement path of the balancing unit, the housing power line supplying power to the balancing unit; and a power supply unit to supply power to the housing power line, wherein the power supply unit includes:

a first supply unit secured to the bearing housing, the first supply unit connected to a power source;

a second supply unit secured to the rotor or the rotating shaft, the second supply unit continuously comes into contact with the first supply unit during rotation of the rotor; and a connection line to connect the second supply unit and the housing power line to each other, and wherein the balancing unit includes a balancing unit power line coming into contact with the housing power line.

2. The apparatus according to claim 1, wherein the power supply unit is located at the outside of the tub.

3. The apparatus of claim 1, wherein the rotating shaft has a shaft bore perforated in the center thereof, and wherein the connection line is inserted into the shaft bore to connect the second supply unit and the housing power line to each other.

4. The apparatus of claim 1, wherein the rotating shaft has a groove formed in a longitudinal direction thereof, and wherein the connection line is inserted in the groove to connect the second supply unit and the housing power line to each other.

5. The apparatus of claim 1, wherein the housing power line has a width equal to or greater than a width of the balancing unit power line.

6. The apparatus of claim 1, wherein the housing power line includes a plurality of lines and the balancing unit power line is equal in number to the housing power line.

7. The apparatus of claim 1, wherein the housing power line protrudes from a surface of the housing defining the receiving space.

8. The apparatus of claim 7, wherein the housing power line is located at one surface of the housing defining the receiving space, the surface being parallel to a lower surface of the balancing unit.

9. The apparatus of claim 8, wherein the housing power line is additionally located at one surface of the housing defining the receiving space, the surface being parallel to a lateral surface of the balancing unit.

10. The apparatus of claim 1, further comprising:

an arm secured to the drum, the arm extending in a diameter direction of the drum, wherein the connection line penetrates the arm and is guided to the housing power line.

11. The apparatus of claim 10, wherein the balancer includes a rear balancer secured to a rear face of the drum, the arm being located at the rear face, and a front balancer secured to a front face of the drum, and wherein the connection line includes a front connection line connecting the housing power line of the front balancer and the second supply unit to each other and a rear connection line connecting the housing power line of the rear balancer and the second supply unit to each other.

12. The apparatus of claim 10, wherein the balancer includes a rear balancer secured to a rear face of the drum, the arm being located at the rear face, and a front balancer secured to a front face of the drum, and wherein the connection line includes a main connection line connected to the second supply unit, a front connection line diverged from the main connection line and connected to the housing power line of the front balancer, and a rear connection line diverged from the main connection line and connected to the housing power line of the rear balancer.

13. The apparatus of claim 1, wherein the at least one balancing unit includes at least two balancing units received in the receiving space, and the respective balancing units are movable independently of each other in the receiving space.

* * * * *